US012127604B1

(12) United States Patent
Jhaj

(10) Patent No.: US 12,127,604 B1
(45) Date of Patent: Oct. 29, 2024

(54) ROMPER STYLE GARMENT

(71) Applicant: Parneet Kaur Deol Jhaj, Bakersfield, CA (US)

(72) Inventor: Parneet Kaur Deol Jhaj, Bakersfield, CA (US)

( * ) Notice: Subject to any disclaimer, the term of this patent is extended or adjusted under 35 U.S.C. 154(b) by 0 days.

(21) Appl. No.: 18/515,670

(22) Filed: Nov. 21, 2023

Related U.S. Application Data

(60) Provisional application No. 63/427,025, filed on Nov. 21, 2022.

(51) Int. Cl.
*A41B 1/06* (2006.01)

(52) U.S. Cl.
CPC ..... *A41B 1/06* (2013.01); *A41B 2300/324* (2013.01)

(58) Field of Classification Search
CPC ... A41B 13/005; A41B 13/08; A41B 13/1236; A41B 13/04; A41B 1/06; A41D 15/002; A41D 15/005; A41D 15/00; A41F 17/00
See application file for complete search history.

(56) References Cited

U.S. PATENT DOCUMENTS 1,172,615 A * 2/1916 Lelansky ..... A41D 15/00 2/70
2,714,718 A * 8/1955 Kramer ..... A41D 15/002 D2/761
2,725,565 A * 12/1955 Wyner ..... A41B 13/00 2/112
3,418,659 A * 12/1968 Brown ..... A41F 5/00 2/70
4,535,480 A 8/1985 Kunieda
4,941,213 A * 7/1990 Grilliot ..... A41D 13/0005 2/232
5,539,932 A * 7/1996 Howard ..... A41D 1/06 2/269
6,223,352 B1 * 5/2001 Watlington ..... A41D 15/002 2/83
9,226,532 B2 * 1/2016 Orozco ..... A41D 11/00
2007/0266472 A1 * 11/2007 DuFaux ..... A41D 15/002 2/80
2016/0037880 A1 * 2/2016 Syms ..... A44C 25/00 63/3.2
2016/0050980 A1 * 2/2016 Cartozian ..... A41B 1/06 2/70
2016/0324238 A1 * 11/2016 Tran ..... A41B 1/06
2018/0295900 A1 * 10/2018 Murphy ..... A41D 1/08
2020/0359723 A1 11/2020 Barfield

OTHER PUBLICATIONS

Rehna Raiya, First to market jumpsuits and romper concept, https://www.rehnaraiya.com/ Los Angeles, California, Dec. 18, 2021.

* cited by examiner

*Primary Examiner* — Jillian K Pierorazio
(74) *Attorney, Agent, or Firm* — Plager Schack LLP; Mark H. Plager; Naomi Mann

(57) ABSTRACT

A romper or jumpsuit style garment system comprises a top garment shirt piece, a bottom garment pant piece, and a garment attachment system for connecting the top and bottom garment pieces. The garment attachment system utilizes snap connectors which are spaced sufficiently apart to provide ample finger space clearance distance between adjacent snaps, which allows a wearer to easily fasten and unfasten the snaps.

7 Claims, 4 Drawing Sheets

ROMPER STYLE GARMENT

RELATED APPLICATION

This application claims benefit to U.S. Application No. 63/427,025 filed Nov. 21, 2022, which is incorporated by reference herein in its entirety.

BACKGROUND

The present disclosure relates generally to jumpsuit and/or romper type garments. A jumpsuit or romper style garment includes connected top and bottom pieces, wherein the bottom piece comprises full-length pant bottoms or shorts. Wearers (typically women and girls) may find such a garment system to be stylish, and comfortable for work, events or simply for active wear. As such, an improved jumpsuit/romper style garment system is desirable.

SUMMARY

According to various embodiments, disclosed is a romper or jumpsuit style garment system comprising a top garment shirt piece, a bottom garment pant piece, and a garment attachment system utilizing snap connectors for connecting the top and bottom garment pieces, wherein the snap connectors are spaced sufficiently apart to provide ample finger space clearance between adjacent snap components, which allows a wearer to easily undo and re-do the snaps.

In certain embodiments, the garment attachment system includes two total bottom strips, one connected at a left inner side of the bottom garment piece and the other connected at a right inner side of the bottom garment piece; and two total top strips, one connected at a left side of the top garment piece and the other connected at a right side of the top garment piece. In some embodiments, each strip of the top and bottom strips includes multiple snap components which are vertically aligned on the strip, wherein snap components on the top strips are configured to mate with snap components on the bottom strips, and wherein a space between adjacent snap components is approximately one inch or greater.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

According to various embodiments as depicted in FIGS. 1-6, disclosed is a romper or jumpsuit style garment system

Figure 1:
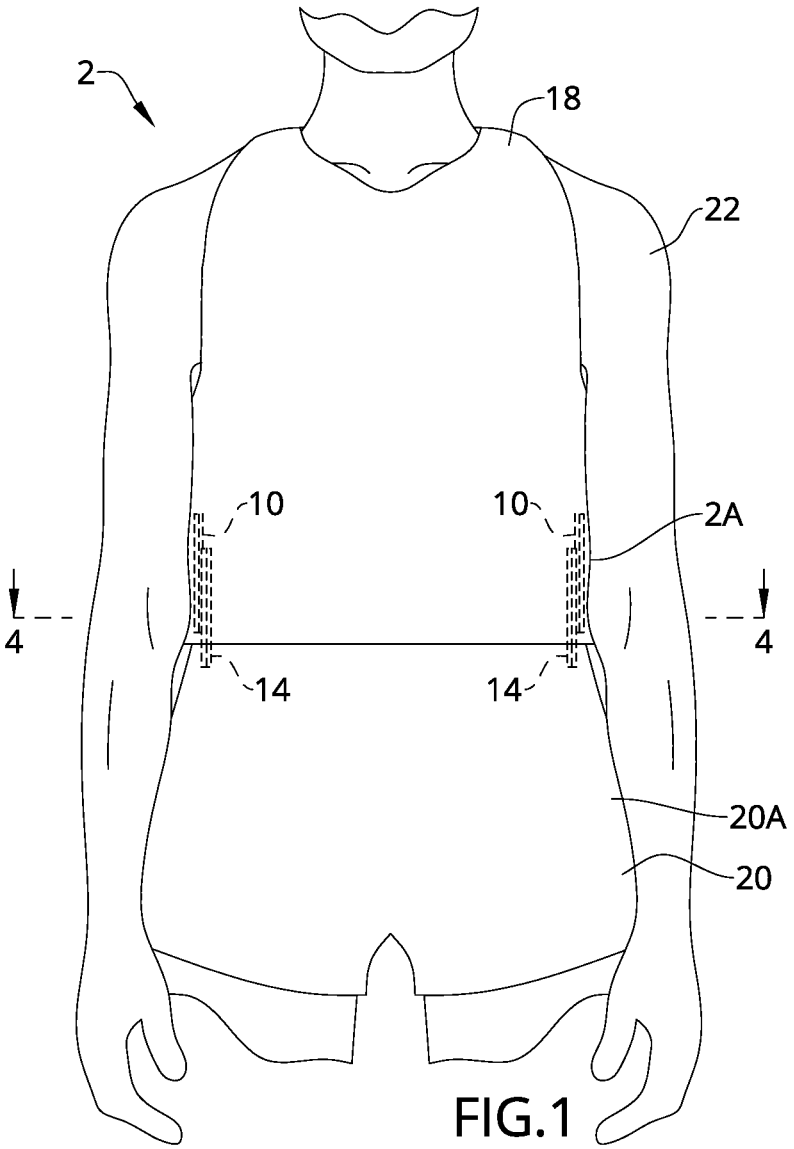
FIG. 1 is a front view of a garment system including top and bottom pieces that are attached via a garment attachment system according to various embodiments, the garment system being in romper style and shown worn by a user.
Figure 2:
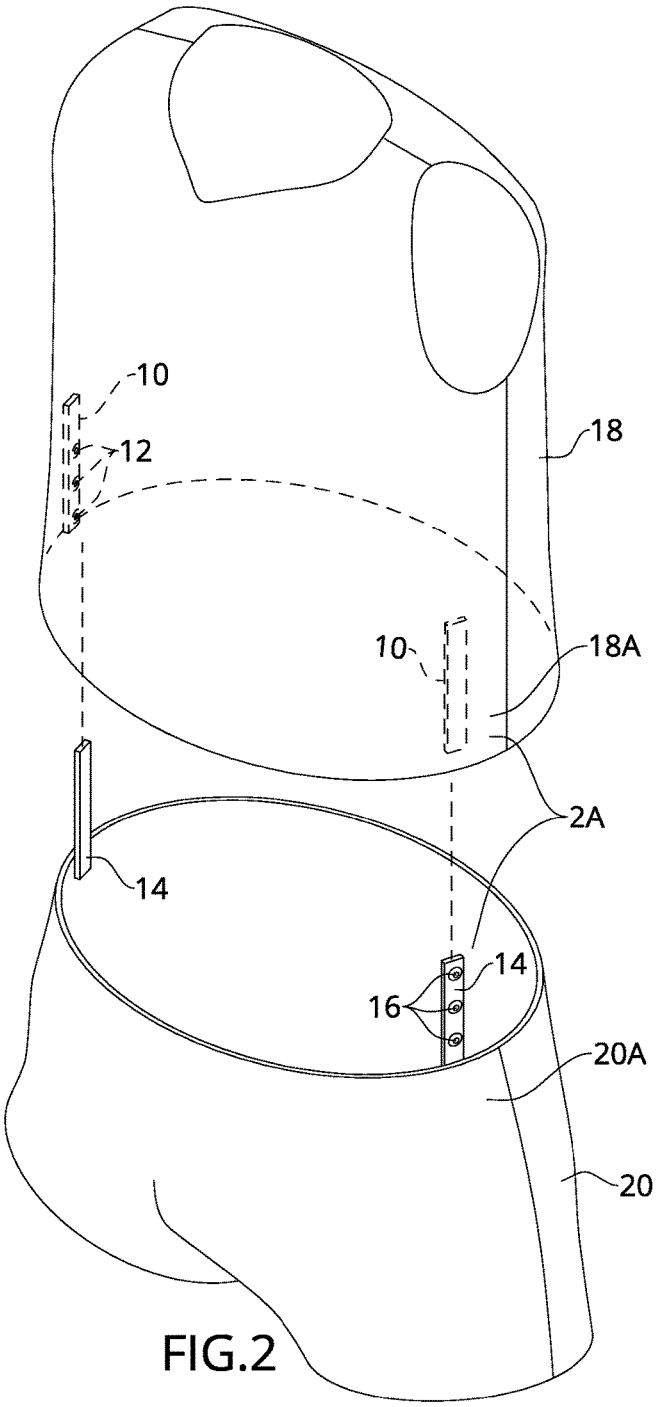
FIG. 2 is an exploded view of the garment system of FIG. 1.
Figure 3:
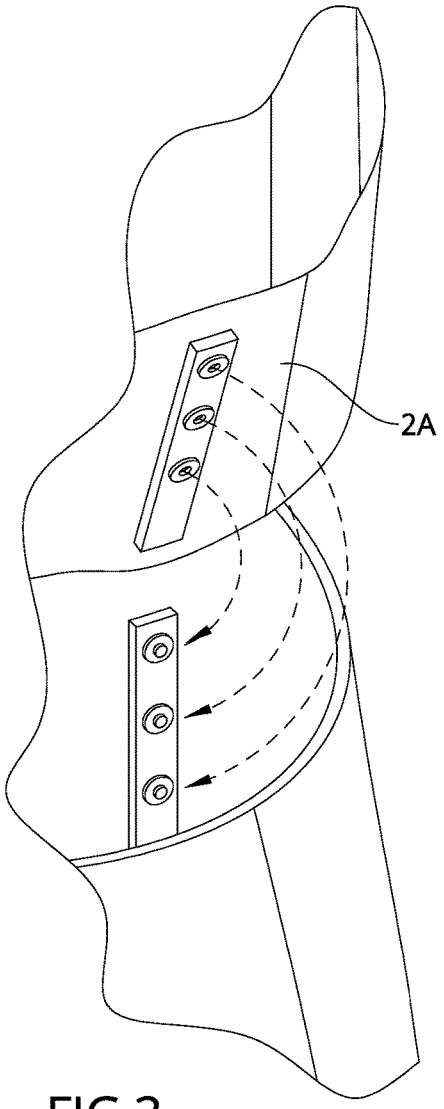
FIG. 3 is a detailed view of the garment attachment system.
Figure 4:
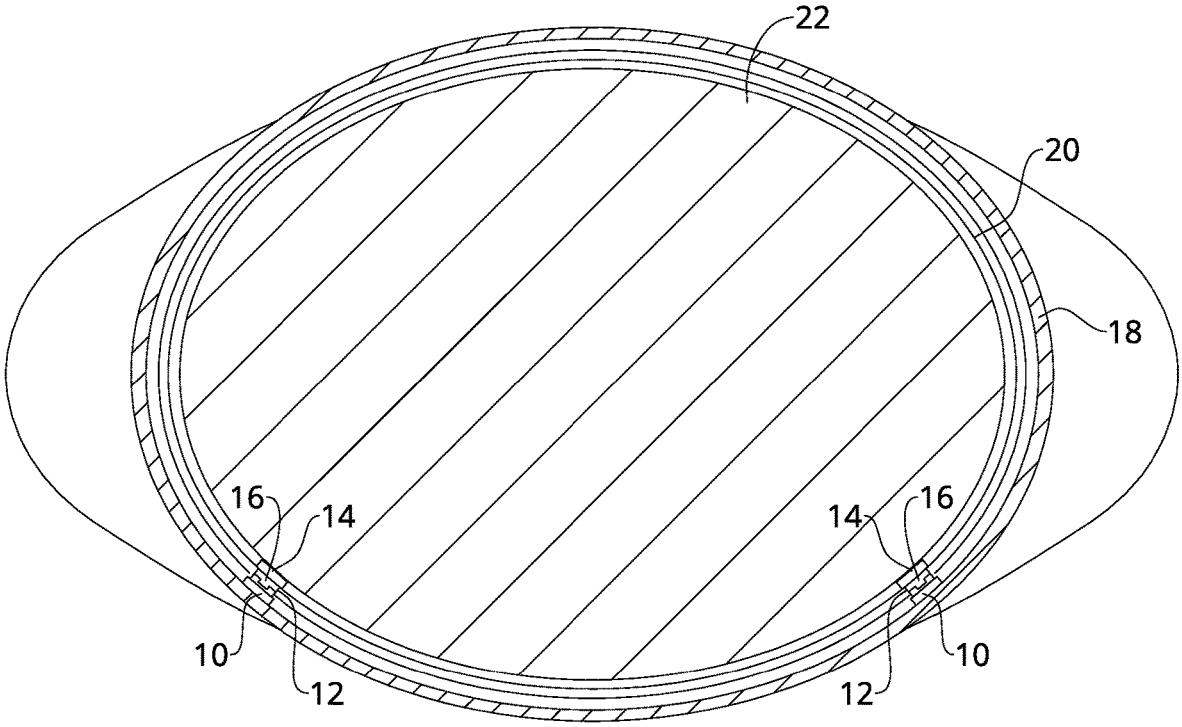
FIG. 4 is a section view taken along line 4-4 in FIG. 1.
Figure 5:
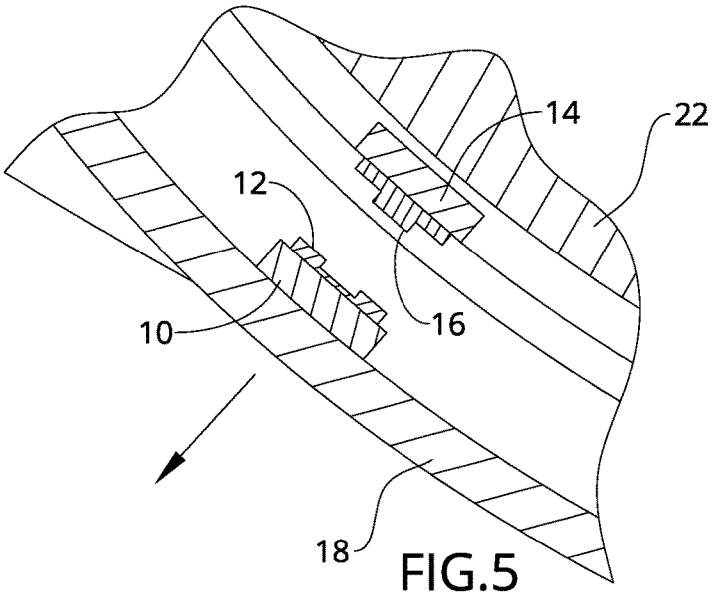
FIG. 5 is a detailed section view showing the garment attachment system in an unfastened state.
Figure 6:
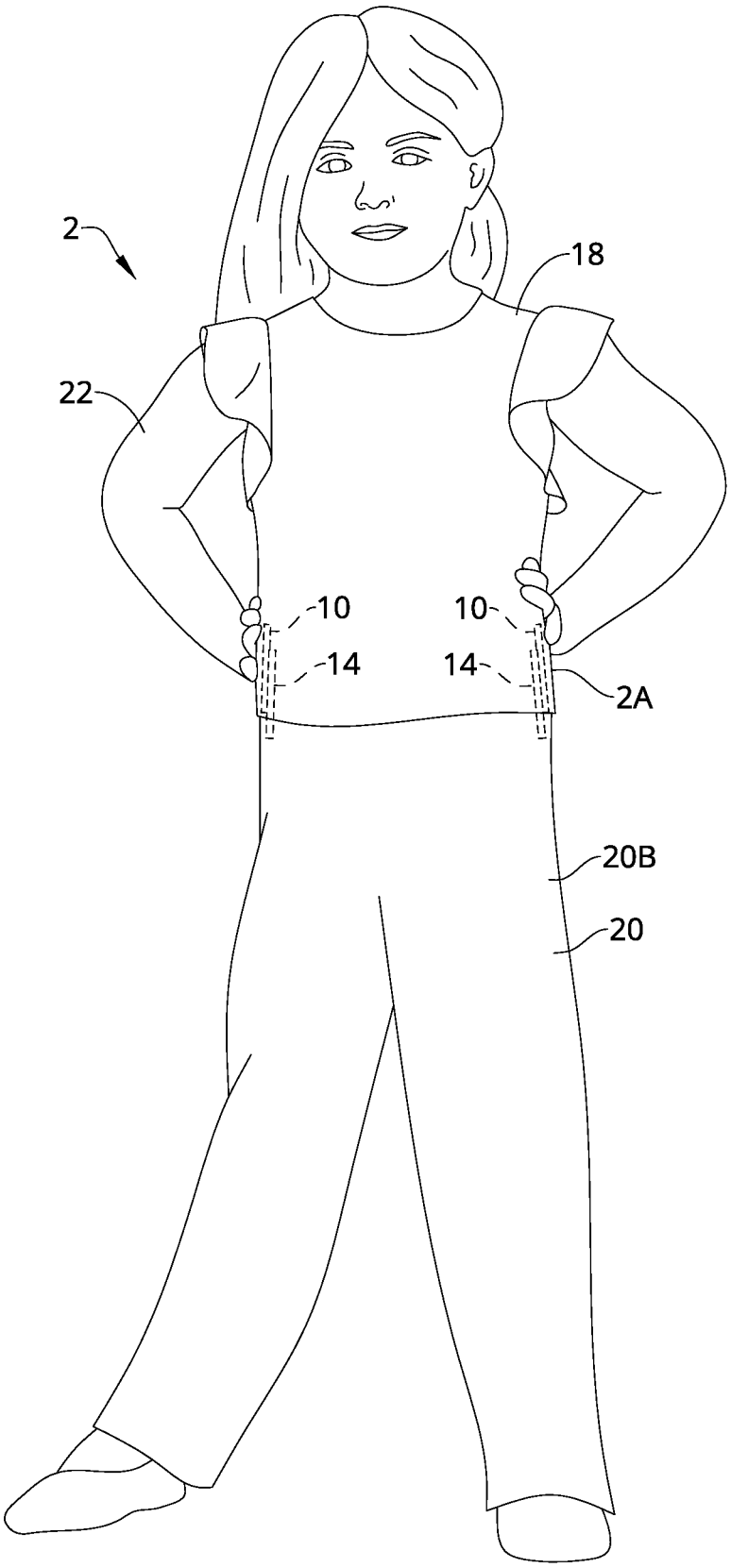
FIG. 6 is a front view of the garment system in jumpsuit style, according to an alternate embodiment.

2 comprising a top garment shirt piece 18 and a bottom garment pant piece 20, which are connected to one another via a garment attachment system 2A. In embodiments, top garment shirt piece 18 may be a blouse and/or shirt of any style, which may be sleeveless or have sleeves of any length. Bottom garment pant piece 20 may comprise shorts 20A of any length (including knee length) for a romper styled garment as depicted in FIGS. 1-5, or partial to full-length pant bottoms 20B for a jumpsuit style as shown in FIG. 6. In some embodiments, bottom garment pant piece 20 may have an elastic waist band, but not necessarily so. In some embodiments, top garment piece 18 and bottom garment piece 20 have a matching/complimentary style (e.g., the same colors and/or patterns) to provide a uniformed look. In certain embodiments, garment attachment system 2A utilizes snap connectors to connect top garment piece 18 to bottom garment piece 20, such that the connected top and bottom garment pieces appear and effectively function as a one-piece romper or jumpsuit. Furthermore, Attachment system 2A is configured to allow pieces 18, 20 to be easily and quickly disconnected for greater convenience to a wearer 22, as will be described.

In certain embodiments, attachment system 2A includes at least one top strip 10 coupled to a bottom section 18A of top garment piece 18, and at least one bottom strip 14 coupled to a top section 20A of bottom garment piece 20. Top strip 10 and bottom strip 14 are both oriented vertically within their respective garment pieces, as shown. Furthermore, top strip 10 and bottom strip 14 are located at corresponding locations with respect to one another, such that when both top and bottom garment pieces are worn, top and bottom strips 10, 14, can be overlapped. In certain embodiments, top garment piece 18 includes a pair of top strips 10 and bottom garment piece 20 includes a pair of bottom strips 14. In some embodiments, each of the pair of strips may be disposed around right and left sides of the respective garment piece. In further embodiments, the pair of strips in each garment may be approximately equidistant from a front or back middle section of the garment. In certain embodiments, the strips may be made of a cloth material. It shall be appreciated however, that a different number of strips which may be of various materials, including stretchable material, may be used in alternate embodiments, and that the strips may be located anywhere on the garment pieces. According to an exemplary embodiment, each strip may be a cloth strip of approximately 3.5 to approximately 4.5 inches in length, but is not limited to this option.

In certain embodiments, top strip 10 comprises a plurality of vertically aligned top strip snaps 12, and bottom strip 14 comprises a plurality of vertically aligned bottom strip snaps 16. In further embodiments, top strip snaps 12 are configured to mate with bottom strip snaps 16. In certain embodiments, top strip snaps 12 may be female snaps and bottom strip snaps 16 may be male snaps 16. However, in an alternate embodiment, top strip snaps 12 may be male and bottom strip snaps 16 may be female. In some embodiments, top strip snaps 12 and bottom strip snaps 16 are located at corresponding locations within their respective strips, such that when both top and bottom pieces are worn and the top and bottom strips are overlapped, each snap of top strip snaps 12 is aligned with and configured to fasten to a corresponding snap of bottom strip snaps 14. It shall be appreciated that in alternate embodiments, the plurality of snaps on each strips may take on other configurations and/or that any number of snaps may be provided. For example, snaps may be aligned in a triangular, square, or staggered configuration in alternate embodiments.

As such, when a user wears top and bottom garment pieces 18, 20, strips 10 and 14 allow the garment pieces to be secured via snaps 12 and 16 of attachment system 2A. In some embodiments, each snap strip may be bonded (e.g., via sewing) to an inner side of the respective garment piece. In one embodiment, top strip 10 may be disposed inside top garment piece 18 and is spaced above the bottom edge of the top garment piece, and bottom strip 14 may extend over the top edge of bottom garment piece 20, as shown in the figures. As such, the top and bottom snap strips may inconspicuously connect on the underside of the top garment piece.

In certain embodiments, each of top strip snaps 12 and bottom strip snaps 16 are spaced sufficiently apart from one another to provide sufficient space between adjacent snaps that allows for a user to easily and comfortably insert her fingers between adjacent snaps in order to unfasten the top and bottom garment pieces. This spacing between the snaps, also referred to as "finger space distance," further enables the user to easily match corresponding snaps when fastening the garments. In certain embodiments, the "finger space distance" between adjacent snap components is approximately 1 inch, or greater than 1 inch. It shall be appreciated that the exact finger space distance may vary in alternate embodiments, taking into account the size of the garments and age/size of the intended user. According to an exemplary embodiment, each strip may include 3 snap components. The 3 snap components on each strip may include a central snap component, and top and bottom snap components each having a center which is spaced approximately 1.5 inches away from the center of the central snap component. Additionally, each snap component may be approximately 0.5 inches in diameter, leaving a clear space of approximately 1 inch between adjacent snaps.

Furthermore, the wide spacing between the snaps allows for the garment system to be adjusted to accommodate growing children and further provides sizing versatility. For growing children, the lifetime and extended wear of traditional rompers and jumpsuits is very limited. Due to the nature of traditional one-piece jumpsuits and/or rompers, every time a child grows, no matter how incremental, the garment becomes tighter, particularly in the groin region, making wear of the garment uncomfortable and unpolished in appearance. The disclosed garment system allows for adjustment of the vertical distance between the bottom garment pant piece 20 and the top garment shirt piece 18 by enabling the user to use less than the full number of snap components. So, for example, a child may initially connect all three snap components in the top and bottom strips. As the child becomes taller only two components may be used (i.e., the central and top snaps in the bottom garment piece, against the central and bottom snaps in the top garment piece), to prevent the bottom piece from being pulled up too tightly. As the child grows further, only the top snap in the bottom garment piece and bottom snap in the top garment piece may be used. This allows for extended wear as well as greater flexibility in wear for growing children. Further, this benefits both adult and child consumers, as the garment system provides for more versatile sizing. For example, a medium sized outfit may accommodate both tall and short consumers of a medium body frame.

Hence, the disclosed subject matter provides a comfortable two-piece garment system that looks and functions as a one-piece romper or jumpsuit garment, with an attachment system for connecting top and bottom garment pieces that allows for the pieces to be easily fastened and unfastened. This allows the wearer to use the restroom with ease and/or to wear and take off the garment with less difficulty.

It shall be appreciated that the disclosed garment system can have multiple configurations, including different designs, patterns, etc., in alternate embodiments. In some embodiments, the garment may optionally be worn without connecting the pieces, and/or one of the pieces may be worn with a "mixed and matched" second piece, should the wearer desire to do so. As such, the disclosed subject matter provides a garment which may function as either a one-piece jumpsuit/romper, or as an outfit with two separate pieces. It shall be appreciated that the components of two-piece the garment described in several embodiments herein may comprise any alternative known materials in the field and be of any size and/or dimensions. It shall be appreciated that the components of the garment described herein may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A jumpsuit and/or romper style garment system for adults and children, comprising:

a top outer garment shirt piece;

a bottom outer garment pant piece; and an attachment system for attaching the top garment shirt piece to the bottom garment pant piece, wherein the attachment system comprises a pair of vertically aligned top strips coupled to a lower section of the top garment shirt piece, and a pair of vertically aligned bottom strips coupled to a top section of the bottom garment piece, wherein the pair of top strips are attached to an underside of the top garment shirt piece, wherein a first one of the pair of top strips is attached at around a left side of the top garment shirt piece and a second one of the pair of top strips is attached at around a right side of the top garment shirt piece, wherein the pair of bottom strips are attached to an underside of the bottom garment pant piece, and configured to be overlapped with the pair of top strips in the top garment shirt piece when the top garment shirt piece and the bottom garment pant piece are worn together, a first one of the pair of bottom strips being attached around a left side of the bottom garment pant piece and is configured to overlap with the first one of the pair of top strips, and a second one of the pair of bottom strips being attached around a right side of the bottom garment pant piece and is configured to overlap with the second one of the pair of top strips, wherein the top strips each includes a plurality of top strip snaps, wherein the bottom strips each includes a plurality of bottom strip snaps configured to mate and connect to the plurality of top strip snaps in the respective top strip, wherein the plurality of top strip snaps are arranged to overlap with the plurality of bottom strip snaps when the top garment shirt piece and the bottom garment pant piece are worn in combination by a user and each top strip is positioned against the corresponding bottom strip, such that each snap in the plurality of top strip snaps is positioned to connect to a corresponding snap in the plurality of bottom strip snaps, to enable the top strips to be attached to the bottom strips, wherein the plurality of top strip snaps are spaced away from one another to provide a space of at least one inch between adjacent snaps of the plurality of top strip snaps, wherein the plurality of bottom strip snaps are spaced away from one another in correspondence to the spacing of the top strip snaps to likewise provide a space of at least one inch between adjacent snaps of the plurality of bottom strip snaps, wherein the spacing between adjacent snaps is configured to allow the user to insert a finger between adjacent snaps for undoing the snaps, wherein the pair of bottom strips are configured to extend over a top edge of the bottom garment pant piece, and wherein the pair of top strips do not extend below a bottom edge of the top garment shirt piece, the bottom edge of the top garment shirt piece is further configured to drape over the top edge of the bottom garment piece, such that when the bottom garment pant piece and the top garment shirt piece are worn in combination with the top pair of strips connected to the bottom pair of strips, both the top pair of strips and the bottom pair of strips are concealed.

2. The garment system of claim 1, wherein the top strip snaps are vertically aligned within each of the top strips, and the bottom strip snaps are vertically aligned within each of the bottom strips.

3. The garment system of claim 2, wherein said finger space distance is approximately 1 inch.

4. The garment system of claim 2, wherein said finger space distance is greater than 1 inch.

5. The garment system of claim 2, wherein each of the pair of top strips includes 3 vertically aligned top strip snaps, and each of the pair of bottom strips includes 3 vertically aligned bottom strip snaps.

6. The garment system of claim 5, wherein a central snap component of the top strip snaps has a center which is spaced approximately 1.5 inches away from a center of a top snap component of the top strip snaps, and from the center of a bottom snap component of the top strip snaps, and wherein a central snap component of the bottom strip snaps has a center which is spaced approximately 1.5 inches away from a center of a top snap component of the bottom strip snaps, and from a center of a bottom snap component of the bottom strip snaps.

7. The garment system of claim 2, wherein a space between a top snap in the plurality of bottom strip snaps and a top edge of the strip is smaller than a space between a bottom snap in the plurality of bottom strip snaps and a bottom edge of the strip in each of the bottom strip snaps.

* * * * *